US010526891B2

(12) United States Patent
Bennett et al.

(10) Patent No.: US 10,526,891 B2
(45) Date of Patent: Jan. 7, 2020

(54) DEVICE AND METHOD FOR CUTTING QUARRY STONE

(71) Applicant: Diamond Stone Technologies Inc., Bedford, IN (US)

(72) Inventors: Bryce Bennett, Bedford, IN (US); Gregory K. Smoot, Bedford, IN (US)

(73) Assignee: Diamond Stone Technologies Inc., Bedford, IN (US)

( * ) Notice: Subject to any disclaimer, the term of this patent is extended or adjusted under 35 U.S.C. 154(b) by 55 days.

(21) Appl. No.: 15/940,193

(22) Filed: Mar. 29, 2018

(65) Prior Publication Data

US 2019/0301282 A1 Oct. 3, 2019

(51) Int. Cl.
*B23D 57/02* (2006.01)
*E21C 25/22* (2006.01)

(52) U.S. Cl.
CPC ..... *E21C 25/22* (2013.01)

(58) Field of Classification Search
CPC ..... E21C 25/28; E21C 25/30; E21C 25/32; B28D 1/08–088
See application file for complete search history.

(56) References Cited

U.S. PATENT DOCUMENTS 457,213 A 8/1891 Rettiger
1,565,444 A 12/1925 Hashim
2,079,864 A 5/1937 Lansing
2,336,487 A 12/1943 Lewis et al.
3,360,298 A 12/1967 Stoljarov et al.
4,520,880 A 6/1985 Saito
4,896,648 A * 1/1990 Boller ..... B27B 17/02 125/21
4,998,775 A 3/1991 Hollifield
5,381,616 A 1/1995 Disney
2004/0007225 A1 1/2004 Baratta
2004/0187856 A1 9/2004 Schlough et al.
2006/0217044 A1 9/2006 Volponi

FOREIGN PATENT DOCUMENTS

EP 0014776 A1 * 9/1980 ..... B27B 17/12
EP 1316398 A2 6/2003
EP 1600235 A2 * 11/2005 ..... B27B 17/025
EP 2236260 A1 10/2010
GB 866686 A * 4/1961 ..... E21C 25/30

OTHER PUBLICATIONS

Translation of EP0014776.*

* cited by examiner

*Primary Examiner* — Janine M Kreck
(74) *Attorney, Agent, or Firm* — Barnes & Thornburg LLP

(57) ABSTRACT

A device for cutting a block of stone that includes a support bar including a monolithic metallic plate. The device also includes a wear bar that is secured to the monolithic metallic plate and has a longitudinal slot, and a cutting belt positioned in the longitudinal slot of the wear bar and including a cutting surface to cut the stone. A method of cutting the stone is also disclosed.

20 Claims, 8 Drawing Sheets

DEVICE AND METHOD FOR CUTTING QUARRY STONE

TECHNICAL FIELD

The present disclosure relates generally to cutting machinery, and particularly to devices for cutting stone.

BACKGROUND

A number of devices have been developed to cut stone blocks into smaller slabs for domestic or commercial use. U.S. Pat. No. 4,679,541 discloses one such device. A bar assembly may be used to direct the continuous cutting belt along a substantially straight cutting path. The bar assembly may include a frame and a cutting belt. In prior art devices, the frame included multiple pieces that extend the length of the frame and are welded or secured together with screws. Typically, the width of the continuous cutting belt was no less than 1.5 inches, which resulted in the removal of material along a substantially straight cutting path having a width of at least 1.5 to 1.6 inches. Despite these prior devices, there is still a need to reduce the amount of material removed by the belt during a cutting operation and decrease the amount of time needed for the cutting operation.

SUMMARY

According to one aspect of the disclosure, a device for cutting a block of stone is disclosed. The device includes a platform arranged to lie on ground, a vehicle movably mounted on the platform, and a quarry-bar assembly coupled to the vehicle. The quarry-bar assembly includes a monolithic plate extending along a longitudinal axis and having a solid core, an upper longitudinal end, and a lower longitudinal end spaced apart from the upper longitudinal end.

In illustrative embodiments, a pair of fluid-guide bars are coupled to the monolithic plate and each fluid-guide bar extends outwardly from respective longitudinal ends of the monolithic plate along a length of the monolithic plate and defines inner and outer channels. A pair of wear bars are coupled to respective fluid-guide bars and shaped to define outwardly-facing slots. A cutting belt is positioned in the outwardly-facing slots, the cutting belt having an outwardly-facing cutting surface.

In illustrative embodiments, the each fluid-guide bar includes a plurality of exterior surfaces and a plurality of interior surfaces and the interior surfaces include first left and right interior surfaces and an upward-facing surface that define the inner channels. The interior surfaces further include second left and right interior surfaces and a downward-facing surface that define the outer channels. The upper and lower longitudinal edges of the monolithic guide bar extend into the first channel of each fluid-guide bar and are spaced apart from each fluid-guide bar to provide a first fluid passageway between each fluid-guide bar and each longitudinal edge.

In illustrative embodiments, the quarry bar unit further includes inserts arranged to lie in the outer channel of each fluid-guide bar and the inserts are spaced apart from each fluid-guide bar to provide a second fluid passageway between each insert and each fluid-guide bar. Each insert is formed to include a plurality of transverse through holes arranged generally parallel to one another, and a plurality of lateral through holes arranged generally perpendicular to the transverse through holes.

In illustrative embodiments, the plurality of transverse through holes extend downwardly from the outer fluid passageway and are aligned with complementary through holes formed in each wear bar to allow lubricant to flow from the outer fluid passageway to the cutting belt. Some of the plurality of transverse through holes extend downwardly from the outer fluid passageway and fasteners extend through each wear bar and into the inserts to couple the wear bars to each insert. The plurality of lateral through holes extend inwardly from the fluid-guide bars and fasteners extend through the fluid-guide bars and into the inserts to couple the inserts to each fluid guide bar.

In illustrative embodiments, the cutting belt includes a mounting block having a tongue and a body, the tongue is arranged to extend into the longitudinal slots formed by the wear bars and the body is arranged to extend outwardly from the wear bars to define the outer cutting surface.

In illustrative embodiments, the monolithic plate has a width between about 0.750 inches and about 1 inch. In illustrative embodiments, the cutting belt has a maximum width of about 1 inch.

According to another aspect, a support bar for a cutting device configured to cut a block of stone is disclosed. The support bar includes a monolithic plate having a solid core arranged along a longitudinal axis and a guide assembly coupled to the monolithic plate.

In illustrative embodiments, the guide assembly includes a fluid-guide bar coupled to a longitudinal edge of the monolithic plate and arranged to extend outwardly from the monolithic plate along an entire length of the monolithic plate. The fluid-guide bar define inner and outer channels relative to the longitudinal axis. The guide assembly further includes a wear bar coupled to the fluid-guide bar and shaped to define a longitudinal slot that faces outwardly from the fluid-guide bar and the monolithic plate. A cutting belt is positioned in the longitudinal slot of the wear bar, the cutting belt having an outwardly facing cutting surface.

In illustrative embodiments, the fluid-guide bar includes a plurality of exterior surfaces and a plurality of interior surfaces and the interior surfaces include first left and right interior surfaces and an upward-facing surface that define the inner channel, and the interior surfaces further include second left and right interior surfaces and a downward-facing surface that define the outer channels. The longitudinal edge of the monolithic guide bar extends into the inner channel of the fluid-guide bar and is spaced apart from the fluid-guide bar to provide a first fluid passageway between the fluid-guide bar and the longitudinal edge.

In illustrative embodiments, the quarry bar unit further includes an insert arranged to lie in the outer channel of the fluid-guide bar and the insert is spaced apart from the fluid-guide bar to provide a second fluid passageway between the insert and the fluid-guide bar. The insert is formed to include a plurality of transverse through holes and a plurality of lateral through holes arranged generally perpendicular to the transverse through holes.

In illustrative embodiments, a first set of transverse through holes extend downwardly from the second fluid passageway and are aligned with complementary through holes formed in the wear bar to allow lubricant to flow from the second fluid passageway to the cutting belt. A second set of transverse through holes extend downwardly from the second fluid passageway and receive fasteners that extend through the wear bar and into the insert to couple the wear bar to the insert. The plurality of lateral through holes extend inwardly from the fluid-guide bar and fasteners extend through the fluid-guide bar and into the insert to couple the insert to the fluid guide bar.

BRIEF DESCRIPTION OF THE DRAWINGS

The detailed description particularly refers to the following figures, in which.

DETAILED DESCRIPTION OF THE DRAWINGS

Figure 1:
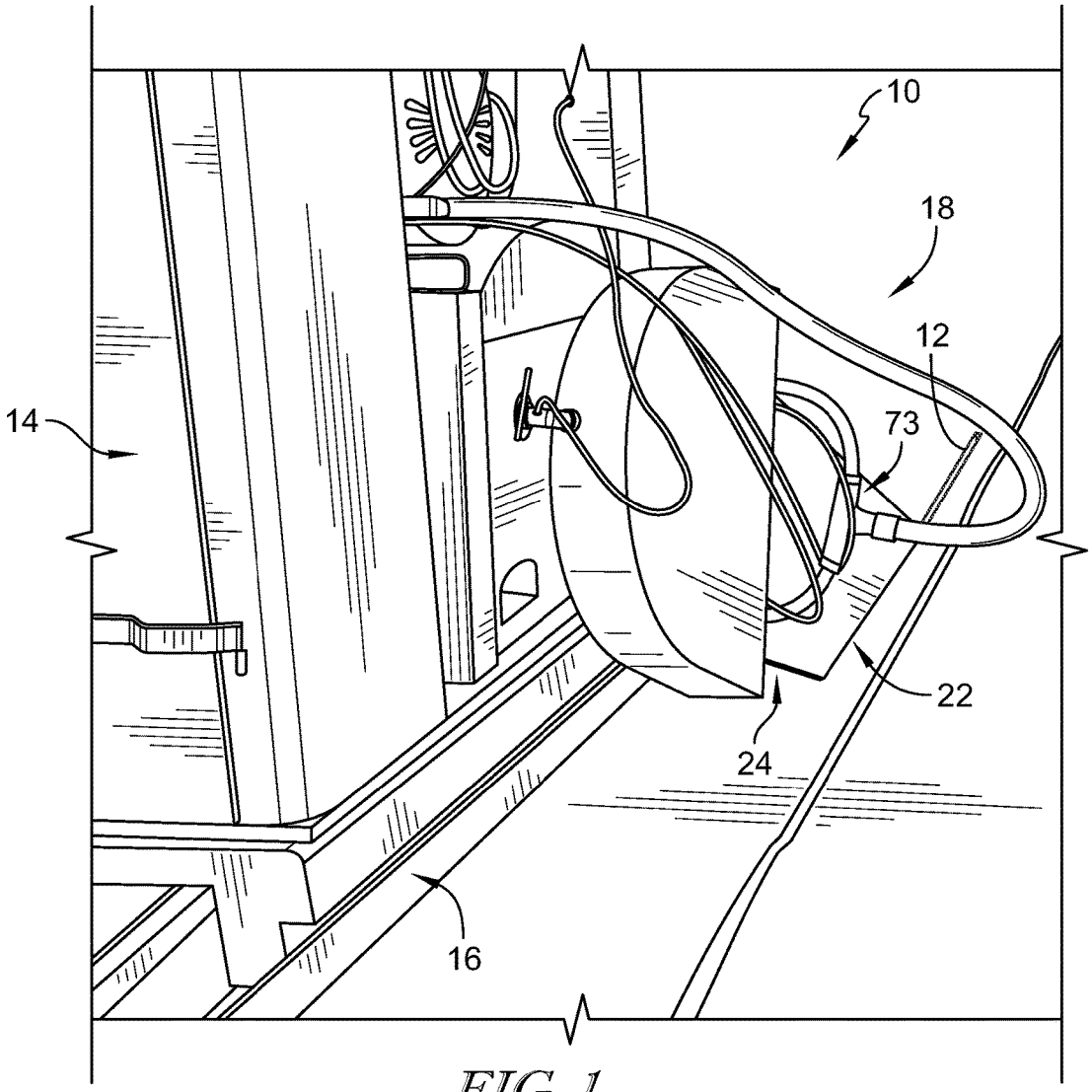
FIG. 1 is a perspective view of a device for cutting a slot in quarry stone.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a device 10 for cutting a slot 12 in quarry stone is shown. The device 10 includes a vehicle 14 adapted to travel along a path defined by a platform 16. As described in greater detail below, the device 10 further includes a quarry bar assembly 18 that directs a cutting belt 20 along a straight path when cutting the slot 12 in the stone. The vehicle 14 of the device 10 may be mounted on rails, wheels, or other support and cooperates with the platform 16 to move the quarry bar assembly 18 along the path. The vehicle 14 has a motor (not shown) that is energized and pulls the cutting belt 20 around the quarry bar assembly 18 to perform a cutting operation forming the slot 12 in the stone during the cutting operation. The quarry bar assembly 18 advances downwardly into the stone to cut the slot 12 in the stone as the vehicle 14 travels along the path defined by the platform 16.

Figure 2:
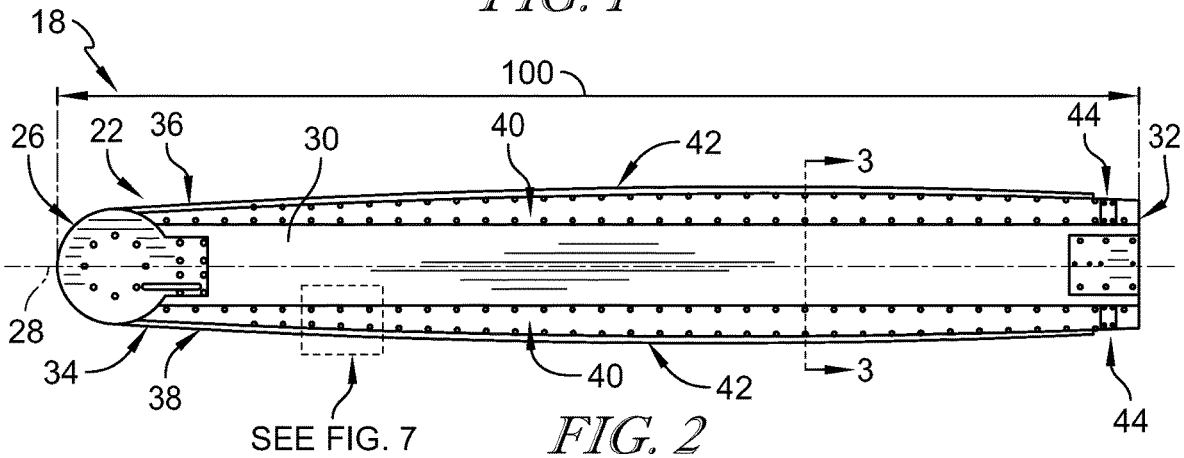
FIG. 2 is a side elevation view of one embodiment of a quarry bar assembly for the device of FIG. 1.

Referring to FIGS. 1 and 2, the quarry bar assembly 18 includes a support bar 22 and a pair of sheave assemblies 24, 26 coupled to the support bar 22. The quarry bar assembly 18 extends a length 100 along a longitudinal axis 28. In the illustrative embodiment, the length 100 is in a range of about 36 inches to about 164 inches. It should be appreciated that in other embodiments the length may vary. A first sheave assembly 24 is coupled to a proximal end of the support bar 22 and the vehicle 14 and is configured to pull the cutting belt 20 around the quarry bar assembly 18 as shown in FIG. 1. A second sheave assembly 26 is coupled to a distal end of the support bar 22, as shown in FIG. 2.

As shown in FIG. 2, the support bar 22 of the quarry bar assembly 18 is shown detached from the device 10. In the illustrative embodiment, the support bar 22 includes a central plate 30 that extends from a proximal end 32 connected to the sheave assembly 24 to a distal end 34 connected to the sheave assembly 26. In illustrative embodiment, the central plate 30 is a monolithic metallic plate that is formed from a single piece of aluminum 6061. In other embodiments, the central plate 30 may be formed from aluminum 7075 or from another suitable metallic material. It should be appreciated that the term "monolithic metallic plate" refers to a metallic structure that is formed from, or is cast as, the single piece of metal.

The support bar 22 also includes an upper guide assembly 36 that is coupled to the upper side of the central plate 30 and a lower guide assembly 34 that is coupled to the lower side of the central plate 30. In the illustrative embodiment, the configuration of the guide assembly 36 substantially mirrors the configuration of the guide assembly 38 such that the same reference numbers are used herein to identify similar features and structures. It should be appreciated that in other embodiments the configurations of the guides may be distinct. As described in greater detail below, each of the guide assemblies 36, 38 includes a fluid-guide bar 40 that is coupled to the central plate 30 and a wear bar 42 coupled to the fluid-guide bar 40 that is configured to guide the cutting belt 20. A fluid port 44 configured to be coupled to a lubricant hose is coupled to each fluid-guide bar 40 to supply lubricating fluid to each of the guide assemblies 36, 38 and hence to the cutting belt 20.

Figure 3:
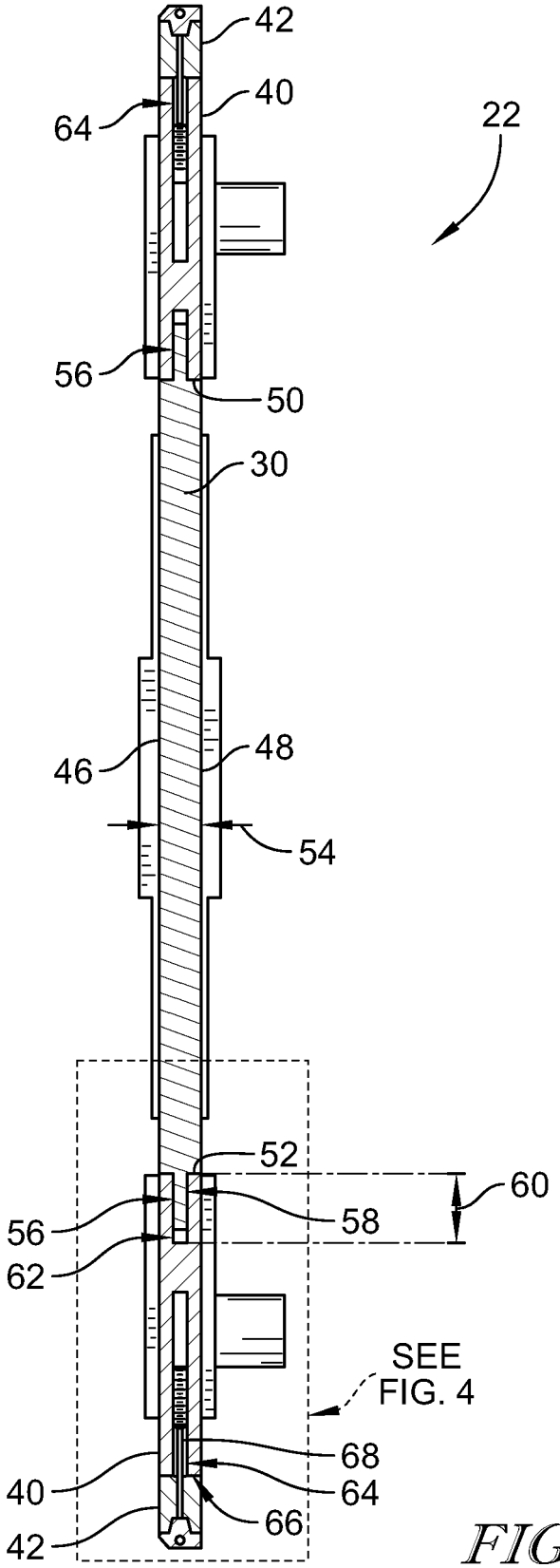
FIG. 3 is an exploded perspective view of a distal end of the quarry bar assembly of FIG. 2.

As shown in FIG. 3, the central plate 30 includes a pair of longitudinal sidewalls 46, 48 that are connected by a top wall 50 and a bottom wall 52 that extend between the ends 32, 34 of the plate 30. The longitudinal sidewalls 46, 48 are substantially planar and define a width 54 of the support bar 22. In the illustrative embodiment, the width 54 is equal to inches. It should be appreciated that the width 54 is less than or equal to the width of the cutting belt 20 and is minimized to reduce the amount of material lost by the passage of the support bar 22.

As described above, each fluid-guide bar 40 is coupled to the central plate 30. In the illustrative embodiment, the central plate 30 also includes a pair of mounting flanges 56 that extend outwardly from the top wall 50 and bottom wall 52, respectively. Each mounting flange 56 is received in an inner channel 58 defined in the fluid-guide bar 40 of each corresponding guide assembly. As shown in FIG. 3, each inner channel 58 extends a depth 60 that is greater than the height of each mounting flange 56 such that an inner fluid passageway 62 is defined by each fluid-guide bar 40 and its corresponding mounting flange 56. As described in greater detail below, the inner fluid passageway 62 is sized to permit lubricant to advance along the length of the support bar 22 to the distal sheave assembly 26.

As shown in FIG. 3, a wear bar 42 is coupled to each fluid-guide bar 40 opposite the central plate 30. In the illustrative embodiment, each of the guide assemblies 36, 38 includes a mounting insert 64 that has an outer edge 66 secured to a wear bar 42 and an inner edge 68 secured to a fluid-guide bar 40. In that way, each wear bar 42 is coupled to its corresponding fluid-guide bar 40 via a mounting insert 64. It should be appreciated that in other embodiments the wear bars 52 may couple directly to the fluid-guide bar 40.

Figure 4:
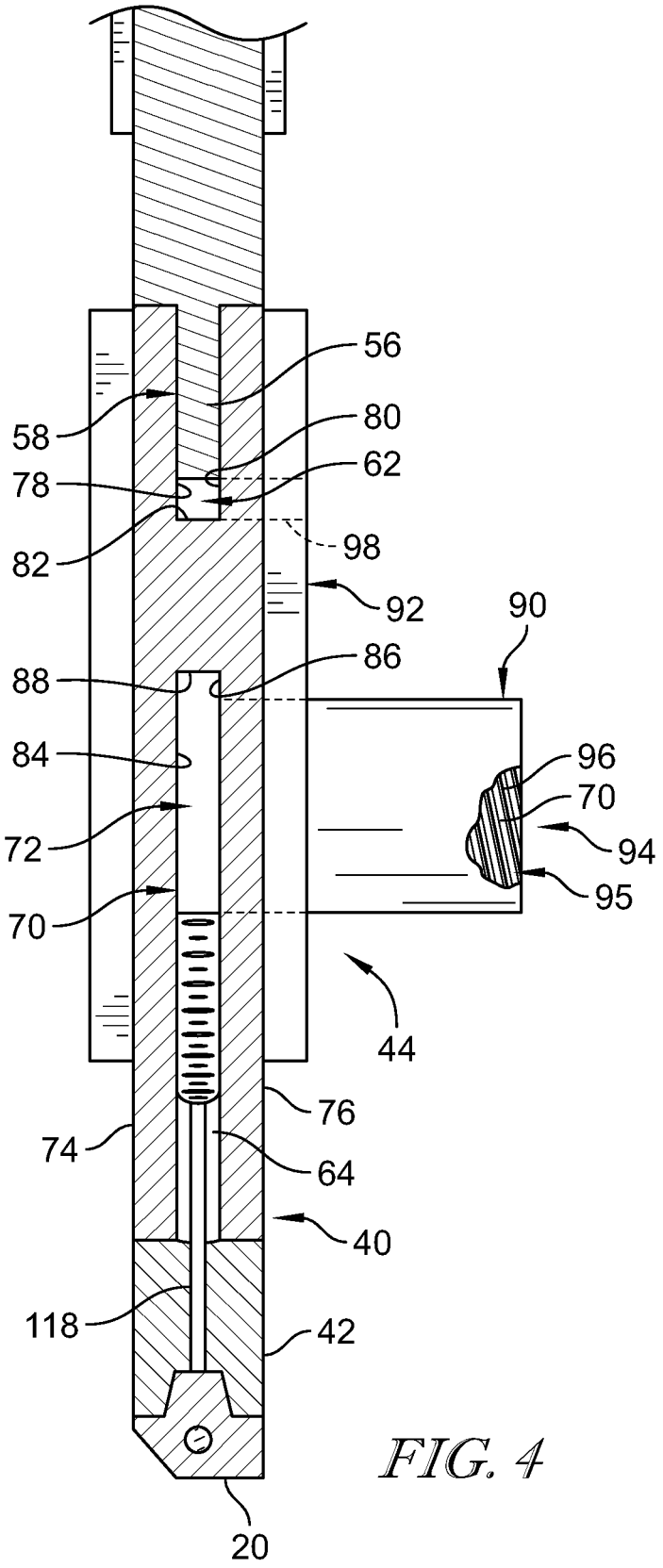
FIG. 4 an exploded perspective view of a proximal end of the quarry bar assembly of FIG. 2.

As shown in FIG. 4, each mounting insert 80 is positioned in an outer channel 70 defined in each fluid-guide bar 40 that is positioned opposite the inner channel 58 of the fluid-guide bar 40. An outer fluid passageway 72, which extends the length of each outer channel 70, is defined between the mounting insert 64 and the fluid-guide bar 40. As described in greater detail below, the outer fluid passageways 72 are sized to permit lubricating fluid to be advanced from the fluid ports 44 along the length of the support bar 22 to transverse passageways 118 defined by the wear bars 42 and the mounting inserts 64, which direct the lubricating fluid to the cutting belt 20.

As shown in FIG. 4, the fluid-guide bar 40 has exterior surfaces 74, 76 and a plurality of interior surfaces that define the inner channel 58 and the outer channel 70. Each inner channel 58 is defined by a first interior surface 78, a second interior surface 80, and an inward-facing surface 82 relative to the axis 28. Similarly, each outer channel 70 is defined by a first interior surface 84, a second interior surface 86, and an outward facing surface 88 relative to the axis 28.

Figure 10:
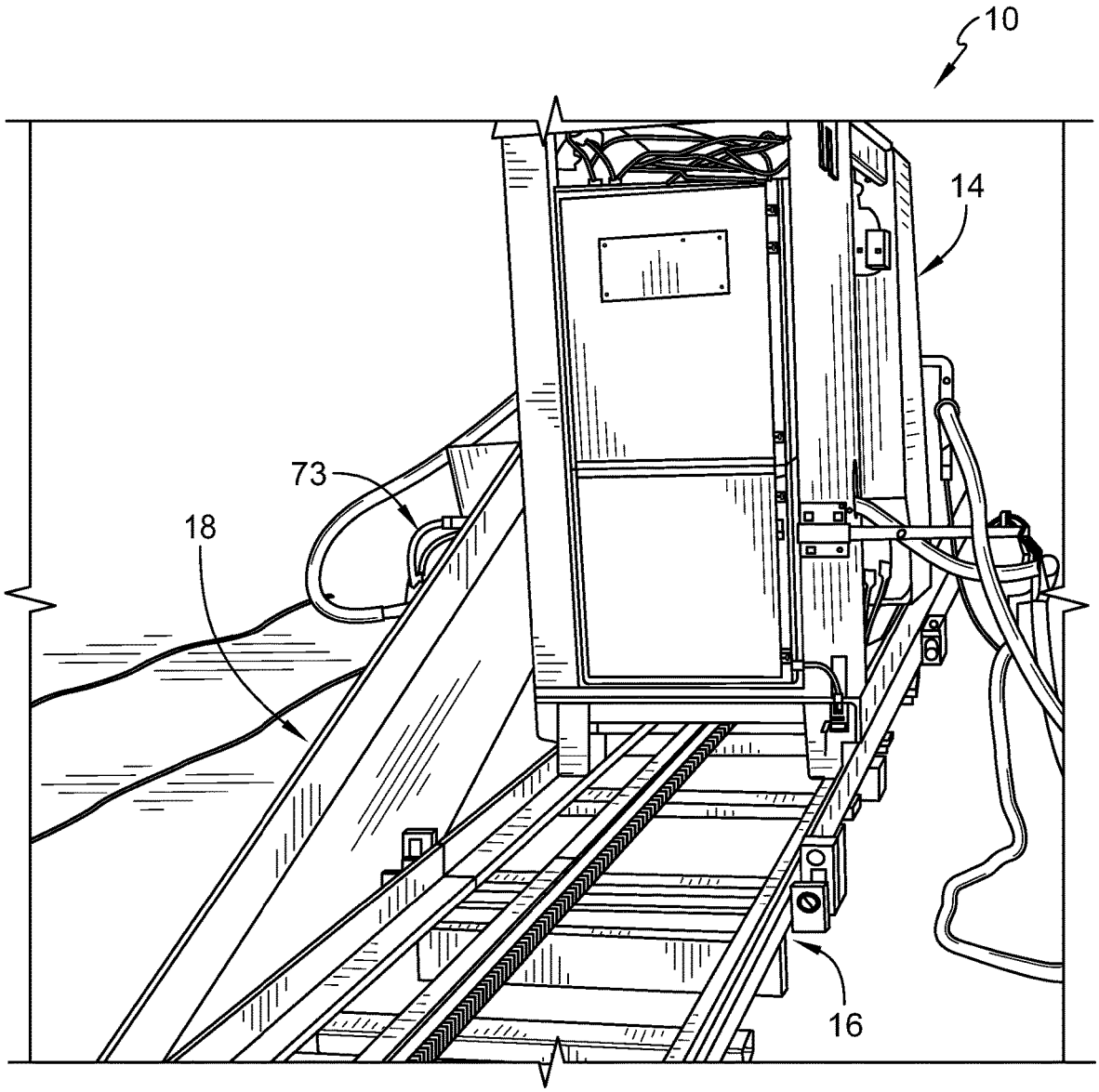
FIG. 10 is a perspective view of the device of FIG. 1 during a cutting operation.

As described above and shown in FIGS. 3 and 4, a number of fluid ports 44 are attached to the fluid-guide bars 40. In the illustrative embodiment, each of the fluid ports 44 has substantially the same configuration. Each fluid port includes a cylindrical body 90 and a metallic plate 92 coupled to the fluid-guide bars 40 via fasteners (not shown). In other embodiments, the plate 92 may be secured to the fluid-guide bars via the use of welding or another suitable method. Each body 90 is cylindrical and extends outward from the plate 92. An opening 94 is defined in the body 90, and a cylindrical inner wall 96 extends inwardly from the opening 94 to define a fluid passageway 95. In the illustrative embodiment, a plurality of threads 71 are defined in the inner wall 68 and are configured to receive a hose connector 73 (see FIGS. 1 and 10) that supplies lubricant fluid.

Each fluid port 44 is coupled to a respective fluid-guide bar 40 in fluid communication with the fluid passageways 62, 72. The cylindrical inner wall 96 of the body 90 defines a passageway 95 through the fluid port 44 that opens into outer fluid passageway 72 in the fluid-guide bar 40. A smaller passageway 98 is formed in the plate 92 and opens into the inner fluid passageway 62. The smaller passageway 98 is inward of the passageway 95 relative to the axis 28. The inner and outer passageways 62, 72 in the fluid-guide bars 40 direct the lubricant fluid from the fluid passageways 95, 98 and toward the cutting belt 20 to lubricate the cutting belt 20 and the stone being cut in the slot 12.

Figure 5:
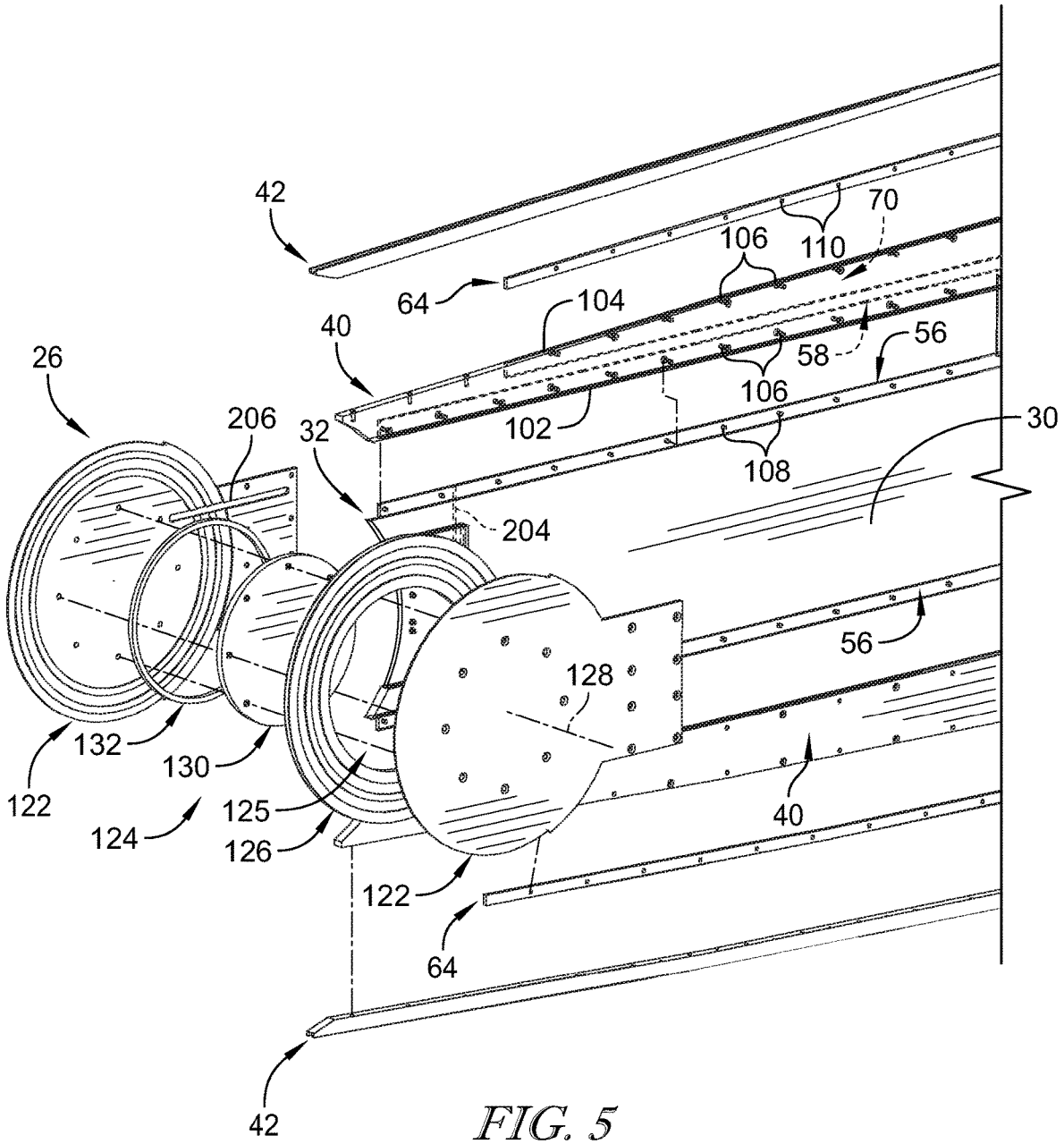
FIG. 5 is a cross-sectional elevation view taken along the line 5-5 in FIG. 2.
Figure 6:
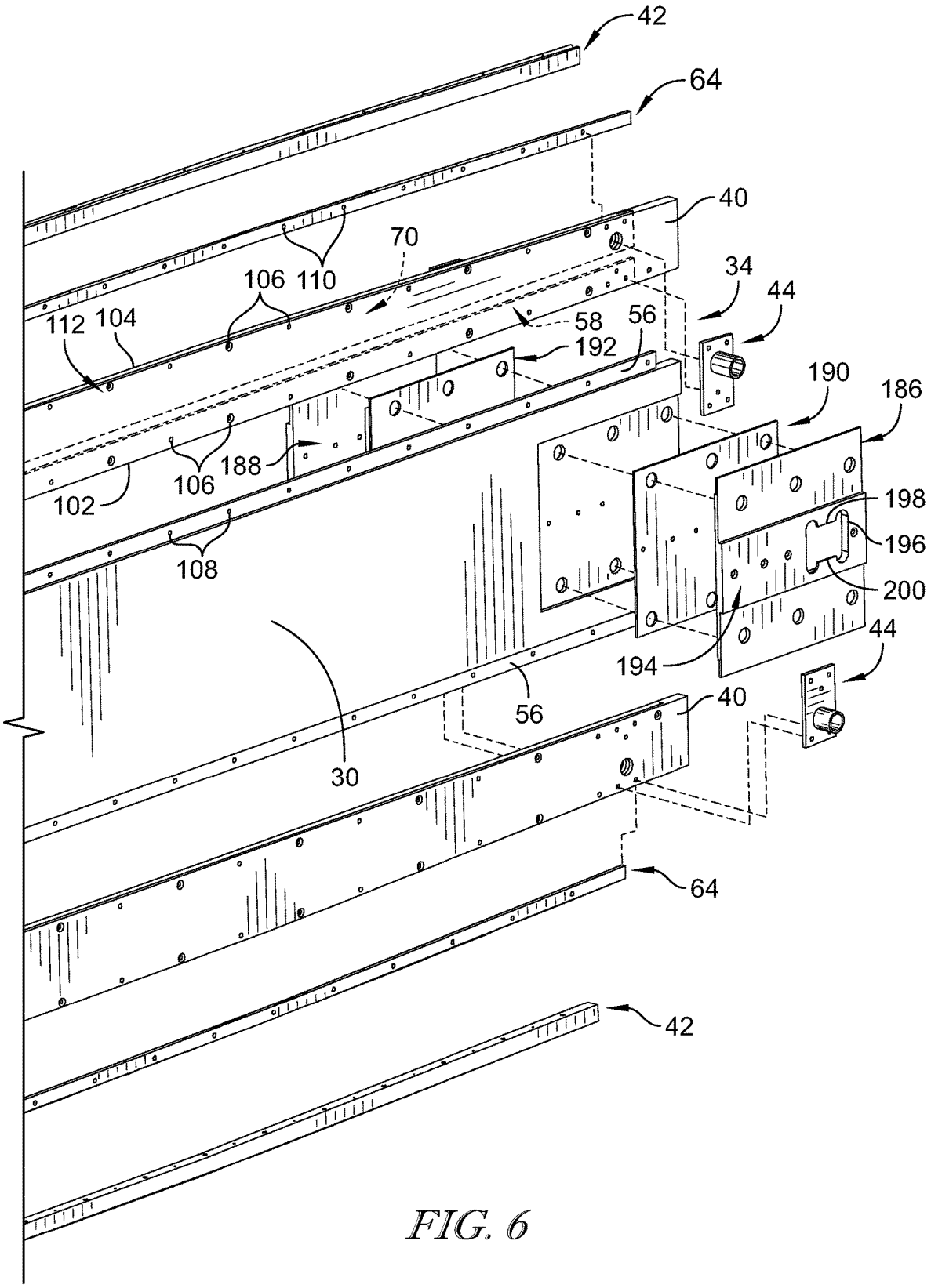
FIG. 6 is detail elevation view of the dashed region in FIG. 5.

Referring now to FIGS. 5 and 6, each fluid-guide bar 40 extends from the distal end 32 of the central plate 30 to the proximal end 34. The fluid-guide bars 50 have an inner longitudinal edge 102 coupled to the central plate 30 and an outer longitudinal edge 104 opposite the inner longitudinal edge 102. The inner longitudinal edge 102 is generally flat. The outer longitudinal edge 104 is bowed and has a height that increases toward a midsection of the fluid-guide bar 40 and decreases from the midsection to the proximal and distal ends 32, 34 of the central plate 30. A height of the inner channel 58 is constant along the length of the inner channel 58. Each of the fluid-guide bars 40 reinforce the support bar 22 to facilitate forming the slot 12 in the stone. Reinforcing the fluid-guide bars 40 minimizes a width of the cutting belt 20 and, therefore, minimizes a width of the slot 12 cut in the stone.

As shown in FIGS. 5 and 6, the inner and outer channels 58, 70 are formed in the fluid-guide bars 50 between the distal and proximal ends 32, 34 of the central plate 30. The inner channel 58 has a length that is longer than the outer channel 70 and shorter than the length of the central plate 30. The outer channel 70 has a length that is shorter than the inner channel 58 and the central plate 30. The wear bars 42 have a length that corresponds with the length of the central plate 30. The inserts 64 have a length that corresponds with the length of the outer channel 70.

As shown in FIGS. 5 and 6, the fluid-guide bar 40 has a plurality of through holes 106 positioned adjacent to the inner and outer edges 102, 104 of the fluid-guide bars 50. Each hole 106 extends from the exterior surfaces to the interior surfaces of the inner and outer channels 58, 70. Fasteners (such as threaded bolts) extend through the holes 106 along the inner edge 102 and into corresponding through holes 108 formed in the flanges 56 to couple the fluid-guide bars 40 to the central plate 30. Additional fasteners (not shown) extend through the holes 102 along the outer edge 104 and into corresponding through holes 110 formed in the inserts 64 to couple the inserts 64 to the fluid-guide bars 40 in the outer channels 70. Each through hole 106 in the fluid-guide bars 40 has a relief 112 so that the fasteners may be countersunk into the fluid-guide bars 40 to fit within the width of the central plate 30. Illustratively, the fasteners alternate extending left-to-right and right-to-left though the fluid-guide bars 40. Alternating the direction the fasteners extend into the fluid-guide bars 40 distribute the forces provided by the fasteners and provide a better fit for the flanges in the inner channels 58.

Figure 7:
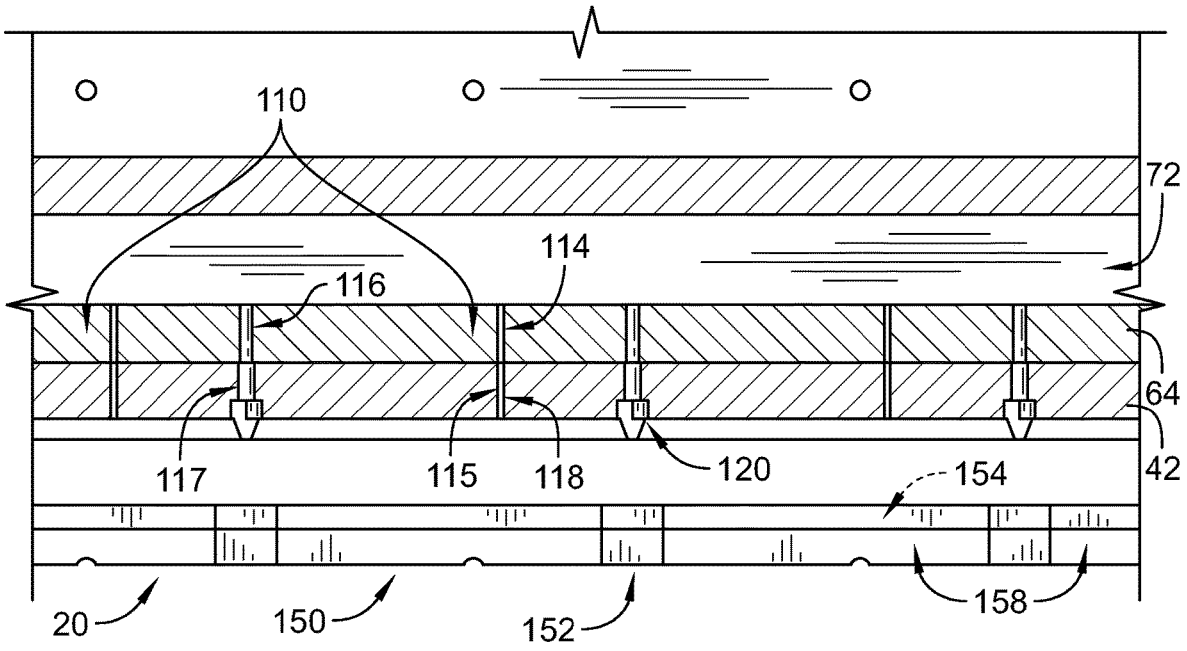
FIG. 7 is a sectional view of the dashed region of the quarry bar in FIG. 2.

As shown in FIGS. 5 and 6 and in greater detail in FIG. 7, each insert 64 includes two sets of transverse through holes 114, 116 that extend radially through the inserts 64. Each of the through holes 114, 116, 110 are spaced apart along a length of the inserts 64 such that none of the through holes overlap and interfere with one another.

As shown in FIGS. 5 and 6, each through hole 114 is aligned with a complementary through hole 115 formed in the wear bars 42 to form the transverse passageways 118 from fluid passageway 72 to the cutting belt 20. The transverse passageways 118 direct fluid from the fluid passageway 72 to the cutting belt 20 to lubricate the cutting belt 20 and the stone.

As shown in FIGS. 5 and 6, each transverse through hole 116 is aligned with a complementary though hole 117 formed in the wear bars 42. Each through hole 116 has a diameter that is larger than the diameter of the through holes 114. Fasteners extend through the complementary through holes 117 formed in the wear bars 42 and into the through holes 116 to couple the wear bars 42 to the inserts 64 via threads. Each through hole 117 in the wear bars 42 has a relief 120 so that the fasteners may be countersunk into the wear bars 42. This allows the cutting belt to move relative to the wear bars 42 around the quarry bar assembly 18 without the fasteners extending into the slots 212, 114 and interfering with the cutting belt 20.

As shown in FIGS. 5 and 6, the sheave assembly 26 has a pair of support plates 122 that are configured to couple the sheave assembly 26 to the central plate 30. Fasteners (not shown) extend through each of the support plates 122 and into the central plate 30. A bearing 124 is located between the support plates 122 and has a central aperture 125. The bearing 124 has an outer race 126 that is configured to rotate about an axis 128 as the cutting belt 20 is pulled by the motor in the vehicle 14. The outer race 126 is formed to include an outward-facing slot 128. An inner race 130 is located in the central aperture 125. Fasteners (not shown) extend through the support plates 122 and into the inner race 130 to couple the bearing 124 to the central plate 30. A roller assembly 132 is also located in the central aperture 125 and is positioned between the inner race 130 and the outer race 126 relative to the axis 128 to allow the outer race 126 to rotate about the axis 128 relative to the inner race 130 during the cutting operation.

As shown in FIG. 5, the central plate 30 is formed to include at least one radially extending bore 204 that extends from the inner fluid passageway 62 toward the axis 28. The bore 204 terminates at a slot 206 formed in at least one support plate 122 of the sheave assembly 26. The slot 206 extends toward the bearing 124. As such, fluid may travel through the first fluid passageway 98, through the bore 204, and through the slot 206 to the bearing 124 to lubricate the bearing 124 and the cutting belt 20.

As shown in FIG. 6, the quarry bar assembly further includes a pair of mount plates 186, 188 that are configured to couple the central plate 30 to the vehicle 14. A pair of spacer plates 190, 192 is coupled to the central plate 30 between the mount plates 186, 188 and the central plate 30. Each of the mount plates 186, 188, the spacer plates 190, 192, and the central plate 30 includes through holes aligned with one another that receive fasteners (not shown) to couple the mount plates 186, 188 and the spacer plates 190, 192 to the central plate 30.

As shown in FIG. 6, each mount plate 186, 188 has a central rib 194 with a thickness that is greater that a thickness of the rest of the mount plate. The rib 194 includes a mounting aperture 196 formed in the rib 196. The mounting aperture 196 is defined by a first projection 198 that extends downwardly toward the axis 28 and a second projection 200 that extends upwardly toward the axis 28. Each of the projections is spaced apart from the spacer plates 190, 192 due to the greater thickness of the rib 194 relative to the rest of the mount plate. The first and second projections cooperate to couple the quarry bar assembly 18 to the vehicle 14.

As shown in FIG. 7, the cutting belt 20 includes a plurality of cutting segments 150, and each cutting segment 150 is secured to a mounting block 152. A single cable 154 extends through a bore 156 defined in each mounting block 152 (See FIG. 8), and a shell 158 is formed over the cable 154 between each mounting block 152 such that the mounting blocks 152 are uniformly spaced apart on the cable 154.

Figure 8:
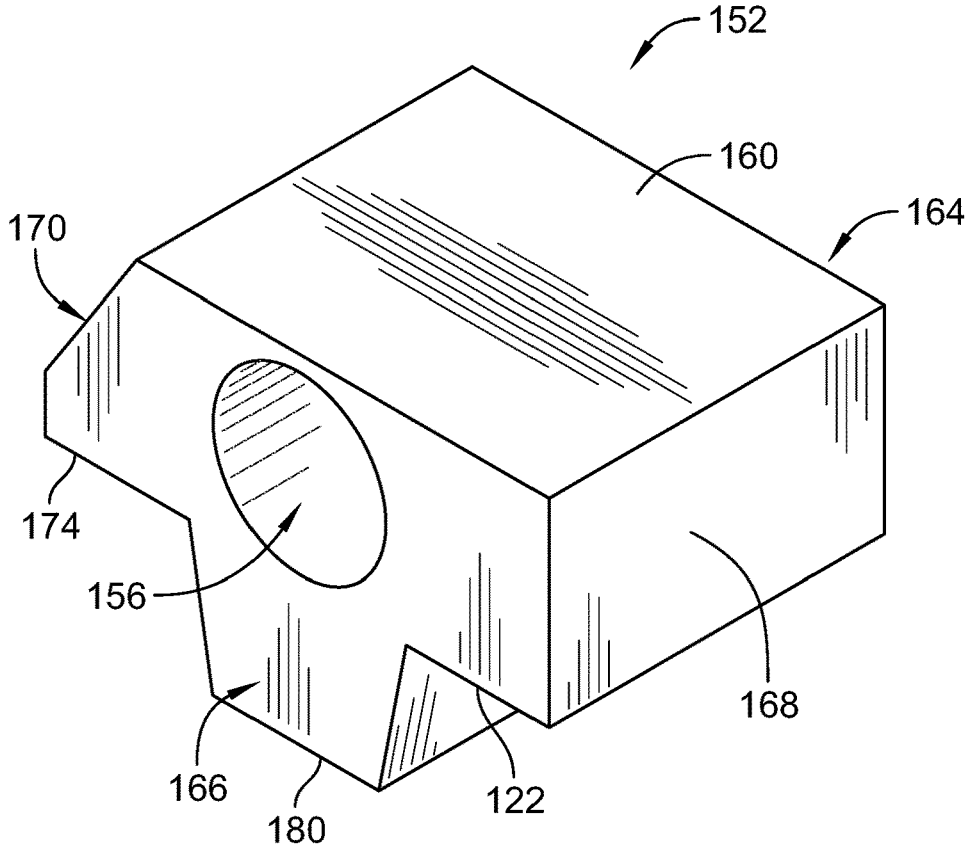
FIG. 8 is a perspective view of a mounting block of the quarry bar assembly of FIG. 2.
Figure 9:
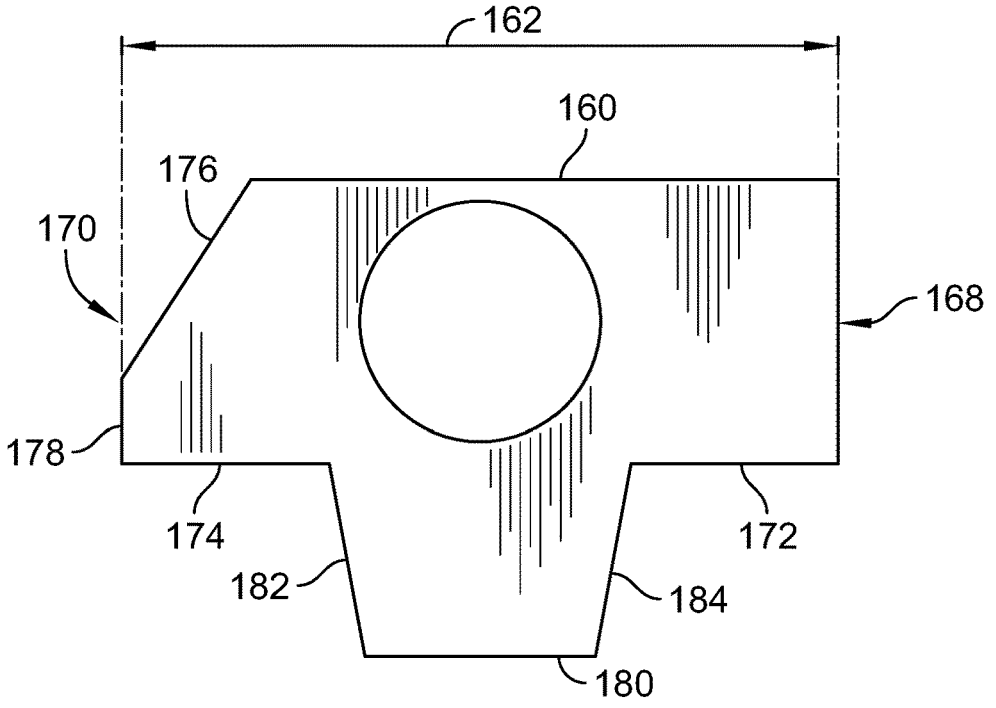
FIG. 9 is a side elevation view of the mounting block of FIG. 8.

Each mounting block 152 of the cutting belt 20 is formed from a metallic material such as, for example, stainless steel, and includes an outer surface 160 configured to cut the stone block 12 as shown in FIGS. 8 and 9. In the illustrative embodiment, the outer surface 160 of each mounting block 152 has diamond particles or diamond powder embedded therein and projecting outwardly therefrom that cut the slot 12 in the stone. It should be appreciated that in other embodiments the outer surface 160 may be coated with an abrasive pad or include a plurality of cutting teeth configured to cut stone.

Referring now to FIGS. 8 and 9, each mounting block 152 further includes a body 164 and a tongue 166 extending away from the body 164. The body 164 includes the outer surface 160, lateral surfaces 168, 170 and bottom surfaces 172, 174. A right lateral surface 168 is generally perpendicular to the outer surface 160 and the bottom surfaces 172, 174. A left lateral surface 170 has a chamfered part 176 that is angled relative to the outer surface 160 and the bottom surfaces 172, 174, and a flat part 178 that is generally perpendicular to the outer surface 160 and the bottom surfaces 172, 174. The chamfered part 176 extends from the outer surface 160 to the flat part 178. The flat part 178 extends from the bottom surface 174 to the chamfered part 176. The chamfered part 176 facilitates cutting the slot 12 in the stone.

As shown in FIGS. 8 and 9, each mounting block 152 of the cutting belt 20 has a width 162 defined between its lateral surfaces. The width 162 defines the cutting width of the belt 20 and thereby directly affects the amount of material that is removed or lost when the slot 12 is cut. In the illustrative embodiment, the width 162 is equal to about 1 inch. In other embodiments, the width 162 may be in a range between about 0.850 inches to about 1.10 inches. As used herein, the term "about" refers to typical machining tolerances such as, for example, ±0.060 inches. In the illustrative embodiment, the width 162 defines the maximum width of the cutting belt 20.

As shown in FIGS. 8 and 9, the tongue 166 has a bottom surface 180 and left and right lateral surfaces 182, 184. The left and right lateral surfaces 182, 184 extend downward from the bottom surfaces of the body 164. Illustratively, the left and right lateral surfaces 182, 184 taper as they extend away from the bottom surfaces 172, 174. It should be appreciated that in other embodiments, the lateral surfaces may not taper. The bottom surface 180 of the tongue 164 is generally perpendicular to the outer surface 160 of the body 164. Each of the surfaces 180, 182, 184 defining the tongue 164 are configured to engage respective surfaces that define the slots 212, 114, 116 formed in the wear bars 108, 110 and the bearing 46.

Each mounting block 152 is also formed from a metallic material such as, for example, stainless steel. In the illustrative embodiment, the cable 154 is formed from woven-metal fiber, and the shell 158 is formed from a plastic or rubber material. The materials used to make the cable 154 and shell 158 are selected to permit the cutting belt 20 to flex as it is pulled around the sheave assemblies 24, 26.

In operation, the platform 16 is positioned adjacent to an area of stone to be cut as shown in FIG. 11. The vehicle 14 is positioned on the platform 16 and the motor is energized so that the motor begins to pull the cutting belt 20 around the quarry bar assembly 18. The quarry bar assembly 18 is then lowered or pivoted downward into engagement with the stone so that the cutting belt 20 begins cutting the slot 12 in the stone as shown in FIGS. 1 and 12. The slot 12 is formed as the vehicle moves along the platform 16.

The wear bars 52 are formed to include outward-facing slots 212. The cutting belt 20 is shaped to lie in the slots 212 and is pulled relative to the wear bars 52 through the slots 212. Fluid is advanced from the fluid supply through the connectors 73 and the fluid ports 44 and into the outer passageways 72 of the fluid-guide bars 40. The fluid is then forced down the passageways 72 and through the transvers though holes 118 of the inserts 64 and the wear bars 42 into the slots 212 defined in the wear bars 42 and over the cutting belt 20. Fluid is also advanced from the fluid supply through the connectors 73 and the fluid ports 44 and into the outer passageways 72 of the fluid-guide bars 40. The fluid is then forced through the inner passageways 62 and down through hole 204 of the central plate 30, into the slots 206 formed in the support plates 122, over the bearing 124 and around the cutting belt 20. As such, as the belt 20 is pulled though the slots 212, fluid is passed over the belt 20 to lubricate the belt 20 (and stone adjacent to the slot 12) during the cutting operation.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A device for cutting a slot in stone, the device comprising:

a platform arranged to lie on ground, a vehicle movably mounted on the platform, and a quarry-bar assembly coupled to the vehicle, the quarry-bar assembly including:

a monolithic plate extending along a longitudinal axis and having a solid core, an upper longitudinal end, and a lower longitudinal end spaced apart from the upper longitudinal end, a pair of fluid-guide bars coupled to the monolithic plate, each fluid-guide bar extends outwardly from respective longitudinal ends of the monolithic plate along a length of the monolithic plate and defines inner and outer channels, and a pair of wear bars, each wear bar coupled to respective fluid-guide bars and shaped to define outwardly-facing slots, and a cutting belt positioned in the outwardly-facing slots, the cutting belt having an outwardly-facing cutting surface.

2. The device of claim 1, wherein the each fluid-guide bar includes a plurality of exterior surfaces and a plurality of interior surfaces and the interior surfaces include first left and right interior surfaces and an upward-facing surface that define the inner channels.

3. The device of claim 2, wherein the interior surfaces further include second left and right interior surfaces and a downward-facing surface that define the outer channels.

4. The device of claim 1, wherein the upper and lower longitudinal edges of the monolithic guide bar extend into the first channel of each fluid-guide bar and are spaced apart from each fluid-guide bar to provide a first fluid passageway between each fluid-guide bar and each longitudinal edge.

5. The device of claim 1, wherein the quarry bar unit further includes inserts arranged to lie in the outer channel of each fluid-guide bar and the inserts are spaced apart from each fluid-guide bar to provide a second fluid passageway between each insert and each fluid-guide bar.

6. The device of claim 5, wherein each insert is formed to include a first plurality of through holes, a second plurality of through holes arranged generally parallel to the first plurality of through holes, and a plurality of lateral-extending through holes arranged generally perpendicular to the first and second pluralities of through holes.

7. The device of claim 6, wherein the first plurality of through holes extend downwardly from the second fluid passageway and are aligned with complementary through holes formed in each wear bar to allow lubricant to flow from the second fluid passageway to the cutting belt.

8. The device of claim 6, wherein the second plurality of through holes extend downwardly from the second fluid passageway and fasteners extend through each wear bar and into the inserts to couple the wear bars to each insert.

9. The device of claim 6, wherein the plurality of lateral-extending through holes extend inwardly from the fluid-guide bars and fasteners extend through the fluid-guide bars and into the inserts to couple the inserts to each fluid guide bar.

10. The device of claim 1, wherein the cutting belt includes a mounting block having a tongue and a body, the tongue is arranged to extend into the longitudinal slots formed by the wear bars and the body is arranged to extend outwardly from the wear bars to define the outer cutting surface.

11. The device of claim 1, wherein the monolithic plate has a width of about 0.750 inches.

12. The device of claim 11, wherein the cutting belt has a width of about 1 inch.

13. A quarry-bar unit, the quarry-bar unit comprising:

a monolithic plate having a solid core arranged along a longitudinal axis, a fluid-guide bar coupled to a longitudinal edge of the monolithic plate and arranged to extend outwardly from the monolithic plate along an entire length of the monolithic plate, the fluid-guide bar defining inner and outer channels relative to the longitudinal axis, a wear bar coupled to the fluid-guide bar and shaped to define a longitudinal slot that faces outwardly from the fluid-guide bar and the monolithic plate, and a cutting belt positioned in the longitudinal slot of the wear bar, the cutting belt having an outwardly facing cutting surface.

14. The quarry-bar unit of claim 13, wherein the fluid-guide bar includes a plurality of exterior surfaces and a plurality of interior surfaces and the interior surfaces include first left and right interior surfaces and an upward-facing surface that define the inner channel, and the interior surfaces further include second left and right interior surfaces and a downward-facing surface that define the outer channels.

15. The quarry-bar unit of claim 14, wherein the longitudinal edge of the monolithic guide bar extends into the inner channel of the fluid-guide bar and is spaced apart from the fluid-guide bar to provide a first fluid passageway between the fluid-guide bar and the longitudinal edge.

16. The quarry-bar unit of claim 14, wherein the quarry bar unit further includes an insert arranged to lie in the outer channel of the fluid-guide bar and the insert is spaced apart from the fluid-guide bar to provide a second fluid passageway between the insert and the fluid-guide bar.

17. The quarry-bar unit of claim 16, wherein the insert is formed to include a first plurality of through holes, a second plurality of through holes arranged generally parallel to the first plurality of through holes, and a plurality of lateral-extending through holes arranged generally perpendicular to the first and second pluralities of through holes.

18. The quarry-bar unit of claim 17, wherein the first plurality of through holes extend downwardly from the second fluid passageway and are aligned with complementary through holes formed in the wear bar to allow lubricant to flow from the second fluid passageway to the cutting belt.

19. The quarry-bar unit of claim 17, wherein the second plurality of through holes extend downwardly from the second fluid passageway and fasteners extend through the wear bar and into the insert to couple the wear bar to the insert.

20. The quarry-bar unit of claim 17, wherein the plurality of lateral-extending through holes extend inwardly from the fluid-guide bar and fasteners extend through the fluid-guide bar and into the insert to couple the insert to the fluid guide bar.

* * * * *